US008984875B2

(12) United States Patent
Jang

(10) Patent No.: US 8,984,875 B2
(45) Date of Patent: Mar. 24, 2015

(54) PUMP CONTROL OPERATING SYSTEM OF CONSTRUCTION MACHINE

(75) Inventor: Dal Sik Jang, Seoul (KR)

(73) Assignee: Doosan Infracore Co., Ltd., Incheon (KR)

( * ) Notice: Subject to any disclaimer, the term of this patent is extended or adjusted under 35 U.S.C. 154(b) by 453 days.

(21) Appl. No.: 13/519,043

(22) PCT Filed: Dec. 23, 2010

(86) PCT No.: PCT/KR2010/009238
§ 371 (c)(1),
(2), (4) Date: Jun. 25, 2012

(87) PCT Pub. No.: WO2011/078588
PCT Pub. Date: Jun. 30, 2011

(65) Prior Publication Data

US 2012/0279211 A1 Nov. 8, 2012

(30) Foreign Application Priority Data

Dec. 24, 2009 (KR) ..... 10-2009-0130693

(51) Int. Cl.
*E02F 9/22* (2006.01)

(52) U.S. Cl.
CPC ..... *E02F 9/2217* (2013.01); *E02F 9/2239* (2013.01); *E02F 9/2282* (2013.01); *E02F 9/2292* (2013.01); *E02F 9/2296* (2013.01)
USPC ..... 60/429; 60/421

(58) Field of Classification Search
USPC ..... 60/421, 422, 428, 429, 430
See application file for complete search history.

(56) References Cited

U.S. PATENT DOCUMENTS

| | | | | |
|---|---|---|---|---|
| 4,369,625 | A * | 1/1983 | Izumi et al. | 60/429 |
| 7,155,908 | B2 * | 1/2007 | Jeon | 60/429 |
| 8,191,290 | B2 * | 6/2012 | Hughes et al. | 37/348 |

FOREIGN PATENT DOCUMENTS

| | | | |
|---|---|---|---|
| CN | 1521407 | | 8/2004 |
| JP | 08-128076 | A1 | 5/1996 |
| JP | 2006-206206 | A | 8/2006 |
| KR | 20-1999-0017303 | U | 5/1999 |
| KR | 10-0473238 | | 6/2005 |

OTHER PUBLICATIONS

Office Action dated Feb. 19, 2014 for Chinese Patent Application No. 201080058814.0, 5 pages.
Search Report dated Aug. 29, 2011 written in Korean for International Application No. PCT/KR2010/009238, filed Dec. 23, 2010, 3 pages.

* cited by examiner

*Primary Examiner* — Thomas E Lazo
(74) *Attorney, Agent, or Firm* — John D. Veldhuis-Kroeze; Westman, Champlin & Koehler, P.A.

(57) ABSTRACT

The present disclosure is a construction machine, such as an excavator, which comprises a plurality of hydraulically driven actuators, in which some of the actuators are provided in a one-to-one pump system where hydraulic pumps are connected to the respective actuators such that a working fluid is supplied from the respective pumps, and the remaining actuators are provided in an auxiliary control valve system where the working fluid is distributed by an auxiliary control valve connected to one or more pumps. When an amount of the working fluid of an actuator associated with the auxiliary control valve is insufficient, the actuator associated with the auxiliary control valve is connected to a pump of the one-to-one pump system to share the pump of the one-to-one pump system.

8 Claims, 1 Drawing Sheet

PUMP CONTROL OPERATING SYSTEM OF CONSTRUCTION MACHINE

This Application is a Section 371 National Stage Application of International Application No. PCT/KR2010/009238, filed Dec. 23, 2010 and published, not in English, as WO2011/078588 on Jun. 30, 2011.

FIELD OF THE DISCLOSURE

The present disclosure relates to a pump control operating system of a construction machine, and more particularly, to a pump control operating system of a construction machine equipped with pumps corresponding to respective actuators.

BACKGROUND OF THE DISCLOSURE

In general, a construction machine is driven by using a hydraulic pressure. The hydraulic pressure is supplied from one or more hydraulic pumps operated by an engine. The hydraulic pumps pressure working oil and supply the pressured working oil to respective actuators. The working oil is properly distributed to the actuators via a distributor called a main control value.

An output of the engine is lost while the working oil passes through hydraulic parts, such as a pump, a pipeline, a valve, a main control valve, for driving a hydraulic pressure. The actuators are operated at an efficiency of approximately 20% of the engine output.

In recent years, studies on pump control systems equipped with pumps for supplying working oil in correspondence to respective actuators to increase an efficiency of a hydraulic system for an output of an engine are being conducted.

Such a pump control system is designed such that pumps driven by an engine directly supply working oil to respective actuators, and is a system for reducing the number of hydraulic elements passing through or controlling the working oil to reduce loss due to hydraulic friction. The pump control system ensures a high efficiency of an engine as a loss of a main control valve distributing the working oil is removed. Further, outputs of the actuators can be easily controlled by regulating an amount of the working oil supplied by the pumps.

In this way, a summary of the technology of such a pump control system has been known, but there are problems in that loads of the actuators driven by the pumps are different, and if an over load is applied to any pump, a flow rate of the working oil supplied to the pump becomes insufficient.

The discussion above is merely provided for general background information and is not intended to be used as an aid in determining the scope of the claimed subject matter.

SUMMARY

This summary and the abstract are provided to introduce a selection of concepts in a simplified form that are further described below in the Detailed Description. The summary and the abstract are not intended to identify key features or essential features of the claimed subject matter, nor are they intended to be used as an aid in determining the scope of the claimed subject matter.

The present disclosure has been made in an effort to solve the above-mentioned problems of the related art, and provides a pump control operating system of a construction machine which can reduce loss of energy of an engine due to actuators to increase an energy efficiency of the engine, and smoothly regulate an amount of supplied working oil according to loads of the actuators.

The present disclosure provides a pump control operating system of a construction machine including a plurality of hydraulically driven actuators, wherein some of the actuators are provided in a one-to-one pump system (A) where hydraulic pumps are connected to the respective actuators such that a working fluid is supplied from the respective pumps, and the remaining actuators are provided in an auxiliary control valve system (B) where the working fluid is distributed by an auxiliary control valve connected to one or more pumps, and wherein when an amount of the working fluid of an actuator associated with the auxiliary control valve is insufficient, the actuator associated with the auxiliary control valve is connected to a pump of the one-to-one pump system (A) to share the pump of the one-to-one pump system (A).

Here, the one-to-one pump system is applied to a boom cylinder, an arm cylinder and a swing motor, the auxiliary control valve system is applied to a driving motor, a bucket cylinder and an option, and a boom pump for driving the boom cylinder is selectively connected to the auxiliary control valve.

The pump control operating system includes: a first boom interrupting valve installed in a hydraulic pressure line connecting the boom pump for driving the boom cylinder and a cylinder rod of the boom cylinder to allow the supply of the working oil; and a second boom interrupting valve connected to a hydraulic pressure line connecting the boom pump and the cylinder rod of the boom cylinder to allow the supply of the working oil to the auxiliary control valve system.

The pump control operating system further includes: a third boom interrupting valve connected to a hydraulic pressure line connecting the boom pump for driving the boom cylinder and a cylinder head of the boom cylinder to allow the supply of the working oil from the auxiliary control valve system.

Meanwhile, the one-to-one pump system is applied to a boom cylinder, an arm cylinder and a swing motor, the auxiliary control valve system is applied to a driving motor, a bucket cylinder and an option, and an arm pump for driving the arm cylinder is selectively connected to the auxiliary control valve to supply the working oil.

The pump control operating system includes: a first arm interrupting valve connected to a hydraulic pressure line for supplying the working oil from the arm pump to a cylinder head of the arm cylinder to allow or interrupt the supply of the working fluid to the auxiliary control valve.

The pump control operating system further includes: a second arm interrupting valve connected to a hydraulic pressure line for supplying the working oil from the arm pump to a cylinder rod of the arm cylinder to allow the supply of the working oil to the auxiliary control valve or allow the supply of the working oil from the auxiliary control valve to an arm rod of the arm cylinder; and a third arm interrupting valve installed in a hydraulic pressure line for supplying the working oil from the arm pump to a cylinder rod of the arm cylinder to allow or interrupt the supply of the working oil from the arm pump to a cylinder rod of the arm cylinder.

In this case, the pump control operating system further includes: a fourth arm interrupting valve connected to a hydraulic pressure line connecting the first arm interrupting valve and the auxiliary control valve to supply the working oil to the boom cylinder.

The above-described pump control operating system of a construction machine according to the present disclosure is configured to allow a working oil of an arm cylinder or a boom cylinder to be supplied to an auxiliary control valve for distributing the working oil to another actuator, thereby supplementing a lack in a flow rate generated in the auxiliary control valve from a pump of a one-to-one pump system and thus ensuring a smooth operation of the actuator operated by the auxiliary control valve.

Further, since the working oil of an arm pump or a boom pump converges into the working oil of the auxiliary control valve to be supplied to the arm cylinder or the boom cylinder oppositely, a lack of the working oil of the arm cylinder or the boom cylinder requiring a large amount of working oil can be solved by the auxiliary control valve.

In addition, since working oil can be supplied from the arm cylinder to the boom cylinder, the required working oil can be supplemented by the arm cylinder according to a load of the boom cylinder.

Figure 1:
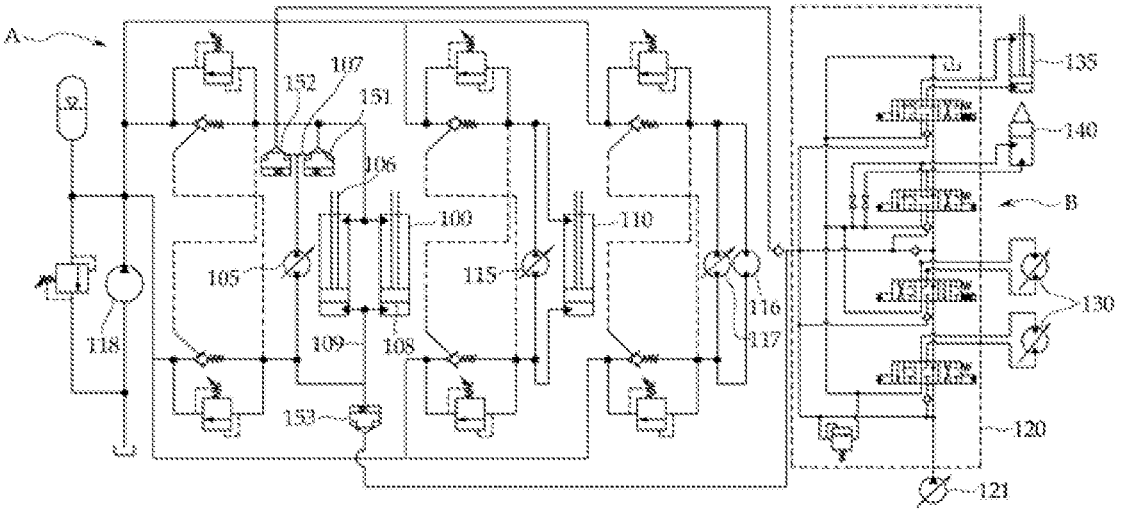
FIG. 1 is a diagram of a pump control operating system of a construction machine according to an exemplary embodiment of the present disclosure.

| | |
|---|---|
| A: One-to-one pump system | B: Auxiliary control valve system |
| 100: Boom cylinder | 105: Boom pump |
| 110: Arm cylinder | 115: Arm pump |
| 120: Auxiliary control valve | 130: Driving motor |
| 135: Bucket cylinder | 140: Option |
| 151: First boom interrupting valve | |
| 152: Second boom interrupting valve | |
| 153: Third boom interrupting valve | |
| 161: First arm interrupting valve | |
| 162: Second arm interrupting valve | |
| 163: Third arm interrupting valve | |
| 164: Fourth arm interrupting valve | |

DETAILED DESCRIPTION

Hereinafter, a pump control operating system of a construction machine according to an exemplary embodiment of the present disclosure will be described with reference to the accompanying drawings. In this process, the thicknesses of lines or the sizes of constituent elements illustrated in the drawings may be exaggerated for clarity and convenience of explanation. The below-described terms are terms defined in consideration of the functions of the present disclosure, and may be changed according to an intention of a user or operator or customs.

Figure 2:
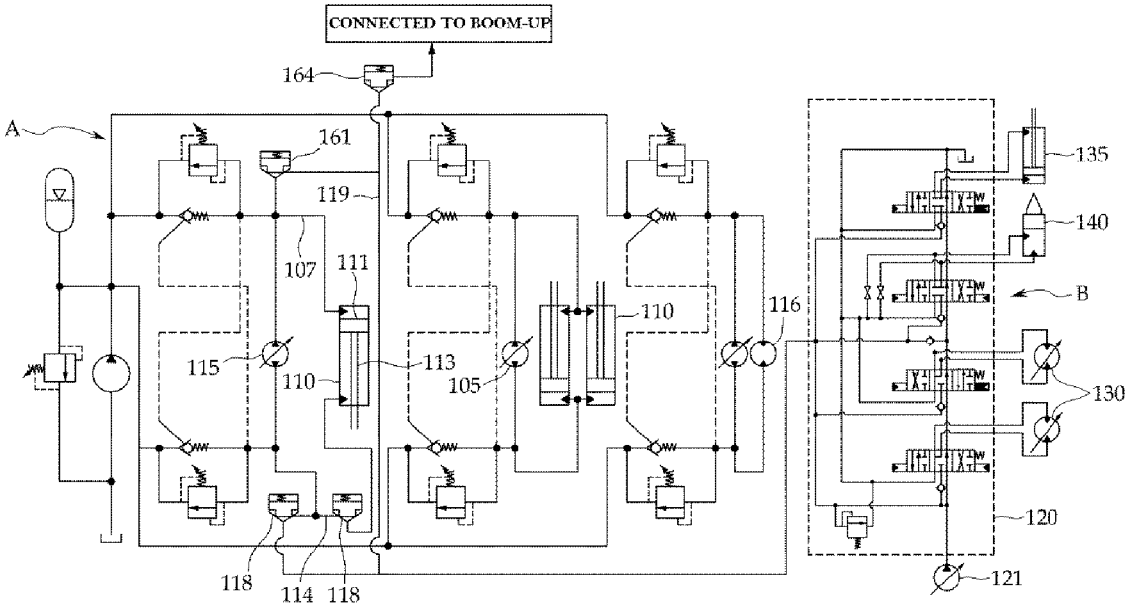
FIG. 2 is a diagram of a pump control operating system of a construction machine according to another exemplary embodiment of the present disclosure.

FIG. 1 is a diagram of a pump control operating system of a construction machine according to an exemplary embodiment of the present disclosure. FIG. 2 is a diagram of a pump control operating system of a construction machine according to another exemplary embodiment of the present disclosure.

Referring to FIG. 1, the pump control operating system of a construction machine according to the exemplary embodiment of the present disclosure is a hydraulic system applied to an excavator, and pumps for supplying working oil may be provided in one-to-one correspondence to actuators. The part where the pumps and the actuators are provided in one-to-one correspondence is defined as a one-to-one pump system A. Another actuator is configured to be driven by one pump 121, and the pump 121 is configured to distribute the working oil to a plurality of actuators through an auxiliary control valve 120 and is called an auxiliary control valve system B.

The one-to-one pump system A which receives a working fluid from the respective pumps is applied to some boom cylinders 100, an arm cylinder 110 and a swing motor 116 of the actuators which are frequently operated and consume much energy, and the auxiliary control valve system B is applied to a driving motor 130, a bucket cylinder 135 and an option 140 which are relatively rarely operated such that the working fluid is distributed by the auxiliary control valve 120 connected to the one pump 121.

The one-to-one pump system A and the auxiliary control valve system B are configured to supply the working fluid in a mutually supplementary way. That is, when an amount of working oil in an actuator (the driving motor 130, the bucket cylinder 135 or the option 140) associated with the auxiliary control valve 120 is insufficient, the actuator associated with the auxiliary control valve 120 is connected to the pump of the one-to-one pump system A to share the pump of the one-to-one pump system A. That is, the boom pump 105 for driving the boom cylinder 100 is selectively connected to the auxiliary control valve 120. The working oil of the boom pump 105 is supplied to the auxiliary control valve 120 to supplement an insufficient amount of working oil of the auxiliary control valve 120.

A first boom interrupting valve 151 is installed in a hydraulic pressure line 107 connecting the boom pump 105 for driving the boom cylinder 100 and a cylinder rod 106 of the boom cylinder 100 to allow or interrupt the supply of the working oil to the cylinder rod 106 of the boom cylinder 100. A second boom interrupting valve 152 is connected to the hydraulic pressure line 107 connecting the boom pump 105 and the cylinder rod 106 of the boom cylinder 100 to allow or interrupt the supply of the working oil from the boom pump 105 to the auxiliary control valve system B.

In describing a state where the first boom interrupting valve 151 and the second boom interrupting valve 152 are opened or closed, when a single high-speed driving operation is required as the driving motor 130 is operated or when an amount of the working oil is insufficient as the driving operation is performed and an operation of the option 140 or the bucket is required at the same time, the first boom interrupting valve 151 is closed and the second boom interrupting valve 152 is opened. The working oil of the boom pump 105 is not supplied to the boom cylinder 100 by the closed first boom interrupting valve 151, and is supplied to the auxiliary control valve 120 via the opened second boom interrupting valve 152 and is supplied to an actuator of the auxiliary control valve 120 whose working oil is insufficient.

A third boom interrupting valve 153 is connected to a hydraulic pressure line 109 connecting the boom pump 105 for driving the boom cylinder 100 and a cylinder head 108 of the boom cylinder 100 to allow or interrupt the supply of a working oil from the auxiliary control valve system B. When a large amount of working oil is necessary for the boom cylinder 100, for example, during a rising operation of the boom cylinder 100, the third boom interrupting valve 153 allows the working oil of the auxiliary control valve system B to be introduced into the cylinder head 108 of the boom cylinder 100.

Referring to FIG. 2, the one-to-one pump system A is applied to the boom cylinder 100, the arm cylinder 110 and the swing motor 116, the auxiliary control valve system B is applied to the driving motor 130, the bucket cylinder 135 and the option 140, and the arm pump 115 for driving the arm cylinder 110 is selectively connected to the auxiliary control valve 120 to supply the working oil. FIG. 2 illustrates a configuration where the arm pump 115 of the one-to-one pump system A and the auxiliary control valve system B supply the working oil in a mutual supplementary way.

That is, a first arm interrupting valve 161 is connected to a hydraulic pressure line 112 for supplying the working oil from the arm pump 115 to the cylinder head 111 of the arm cylinder 110 to allow or interrupt the supply of the working oil to the auxiliary control valve 120. In the case of a single high-speed driving operation, in the case of the high-speed option 140, or when the working oil supplied from the auxiliary control valve 120 is insufficient as a driving operation is required together with an operation of the option 140 or the bucket at the same time, the first arm interrupting valve 161 is opened to allow the working oil of the arm pump 115 to be supplied to the auxiliary control valve 120. The single high-speed driving operation refers to a case of operating the driving motor 130 at a high speed.

A second arm interrupting valve 162 is connected to a hydraulic pressure line 114 for supplying the working oil from the arm pump 115 to the cylinder rod 113 of the arm cylinder 110 to allow the supply of the working oil to the auxiliary control valve 120 or allow the supply of the working oil from the auxiliary control valve 120 to a rod of the arm cylinder 110. When the working oil of the arm pump 115 is supplied to the cylinder rod 113 of the arm cylinder 110, the second arm interrupting valve 162 is closed, and when the working oil is supplied from the auxiliary control valve 120 to the cylinder rod 113 of the arm cylinder 110, the second arm interrupting valve 162 is opened.

A third arm interrupting valve 163 is installed in the hydraulic pressure line 114 for supplying the working oil from the arm pump 115 to the cylinder rod 113 of the arm cylinder 110 to allow or interrupt the supply of the working oil from the arm pump 115 to the cylinder rod 113 of the arm cylinder 110. The third arm interrupting valve 163 is opened when the arm cylinder 110 is normally operated by the arm pump 115. When the first arm interrupting valve 161 is opened and the working fluid of the arm pump 115 is supplied to the auxiliary control valve 120, the third arm interrupting valve 163 is closed to stop an operation of the arm cylinder 110 and allow the working oil of the arm pump 115 to be introduced into the auxiliary control valve 120. When the working fluid of the auxiliary control valve 120 is supplied to the cylinder rod 113 of the arm cylinder 110, the second arm interrupting valve 162 and the third arm interrupting valve 163 are opened.

A fourth arm interrupting valve 164 is connected to a hydraulic pressure line 119 connecting the first arm interrupting valve 161 and the auxiliary control valve 120, and when the boom requires a large amount of working oil, the working oil of the arm pump 115 or the auxiliary control valve 120 may be supplied to the boom cylinder 100.

Meanwhile, the boom interrupting valves 151, 152 and 153 and the arm interrupting valves 161, 162, 163 and 164 are of a poppet valve type which can be opened or closed electrically, and can be opened or closed such that the working fluids of the one-to-one pump system and the auxiliary control valve system B are shared according to a necessary situation of the working fluid. The poppet valve type reduces a pressure reduction loss of the working oil.

Moreover, in FIGS. 1 and 2, a hydraulic pressure line of a swing pump 117 for driving the boom pump 105, the arm pump 115 and the swing motor 116 is configured to supplement the working oil from a charging pump 118.

The present disclosure can be applied to a pump control operating system of a construction machine.

Although the present disclosure has been described with reference to exemplary and preferred embodiments, workers skilled in the art will recognize that changes may be made in form and detail without departing from the spirit and scope of the disclosure.

The invention claimed is:

1. A pump control operating system of a construction machine comprising:

a plurality of hydraulically driven actuators, wherein some of the actuators are provided in a one-to-one pump system where hydraulic pumps are connected to the respective actuators such that a working fluid is supplied from the respective pumps, and the remaining actuators are provided in an auxiliary control valve system where the working fluid is distributed by an auxiliary control valve connected to one or more pumps, and wherein when an amount of the working fluid of an actuator associated with the auxiliary control valve is insufficient, the actuator associated with the auxiliary control valve is connected to a pump of the one-to-one pump system to share the pump of the one-to-one pump system.

2. The pump control operating system of claim 1, wherein the one-to-one pump system is applied to a boom cylinder, an arm cylinder and a swing motor, the auxiliary control valve system is applied to a driving motor, a bucket cylinder and an option, and a boom pump for driving the boom cylinder is selectively connected to the auxiliary control valve.

3. The pump control operating system of claim 2, comprising:

a first boom interrupting valve installed in a hydraulic pressure line connecting the boom pump for driving the boom cylinder and a cylinder rod of the boom cylinder to allow the supply of the working oil; and a second boom interrupting valve connected to a hydraulic pressure line connecting the boom pump and the cylinder rod of the boom cylinder to allow the supply of the working oil to the auxiliary control valve system.

4. The pump control operating system of claim 3, further comprising:

a third boom interrupting valve connected to a hydraulic pressure line connecting the boom pump for driving the boom cylinder and a cylinder head of the boom cylinder to allow the supply of the working oil from the auxiliary control valve system.

5. The pump control operating system of claim 1, wherein the one-to-one pump system is applied to a boom cylinder, an arm cylinder and a swing motor, the auxiliary control valve system is applied to a driving motor, a bucket cylinder and an option, and an arm pump for driving the arm cylinder is selectively connected to the auxiliary control valve to supply the working oil.

6. The pump control operating system of claim 5, comprising:

a first arm interrupting valve connected to a hydraulic pressure line for supplying the working oil from the arm pump to a cylinder head of the arm cylinder to allow or interrupt the supply of the working fluid to the auxiliary control valve.

7. The pump control operating system of claim 6, further comprising:

a second arm interrupting valve connected to a hydraulic pressure line for supplying the working oil from the arm pump to a cylinder rod of the arm cylinder to allow the supply of the working oil to the auxiliary control valve or allow the supply of the working oil from the auxiliary control valve to an arm rod of the arm cylinder; and a third arm interrupting valve installed in a hydraulic pressure line for supplying the working oil from the arm pump to a cylinder rod of the arm cylinder to allow or interrupt the supply of the working oil from the arm pump to a cylinder rod of the arm cylinder.

8. The pump control operating system of claim 6, further comprising:

a fourth arm interrupting valve connected to a hydraulic pressure line connecting the first arm interrupting valve and the auxiliary control valve to supply the working oil to the boom cylinder.

* * * * *